United States Patent [19]

Kato et al.

[11] Patent Number: 4,792,511

[45] Date of Patent: Dec. 20, 1988

[54] ELECTROPHOTOGRAPHIC ZINC OXIDE-RESIN BINDER LITHOGRAPHIC PRINTING PLATE PRECURSOR

[75] Inventors: Eiichi Kato; Ryosuke Itakura; Hidefumi Sera; Kazuo Ishii, all of Shizuoka, Japan

[73] Assignee: Fuji Photo Film Co., Ltd., Kanagawa, Japan

[21] Appl. No.: 25,696

[22] Filed: Mar. 13, 1987

[30] Foreign Application Priority Data

Mar. 14, 1986 [JP] Japan ..... 61-54991

[51] Int. Cl.[4] ..... G03G 5/087

[52] U.S. Cl. ..... 430/87; 430/49; 430/96

[58] Field of Search ..... 430/87, 96

[56] References Cited

U.S. PATENT DOCUMENTS

| | | | |
|---|---|---|---|
| 3,121,006 | 2/1964 | Middleton et al. | 430/87 X |
| 3,445,224 | 5/1969 | Bach et al. | 101/462 |
| 3,533,787 | 10/1970 | Merrill et al. | 430/96 X |
| 3,554,746 | 1/1971 | Merrill | 430/96 X |
| 3,709,684 | 4/1973 | Feltzin et al. . | |
| 3,776,724 | 6/1973 | Usmani . | |
| 3,799,911 | 6/1974 | Dissen . | |
| 3,912,506 | 12/1975 | Merrill | 430/96 |
| 3,923,509 | 5/1975 | Kuehn et al. | 428/480 |
| 3,932,181 | 1/1976 | Ray-Chauduri et al. | 430/87 |
| 4,547,447 | 7/1985 | Ueda | 430/96 X |

FOREIGN PATENT DOCUMENTS

| | | | |
|---|---|---|---|
| 128309 | 12/1984 | European Pat. Off. . | |
| 1141282 | 1/1969 | United Kingdom | 430/87 |
| 1258766 | 12/1971 | United Kingdom . | |
| 1326748 | 8/1973 | United Kingdom . | |
| 1354194 | 5/1974 | United Kingdom . | |
| 1361990 | 7/1974 | United Kingdom . | |
| 1376196 | 12/1974 | United Kingdom . | |
| 1402842 | 8/1975 | United Kingdom . | |
| 1402841 | 8/1975 | United Kingdom . | |
| 1402515 | 8/1975 | United Kingdom . | |
| 1498231 | 1/1978 | United Kingdom . | |
| 1521059 | 8/1978 | United Kingdom . | |
| 2014748 | 8/1979 | United Kingdom . | |

*Primary Examiner*—Roland E. Martin

*Attorney, Agent, or Firm*—Sughrue, Mion, Zinn, Macpeak, and Seas

[57] ABSTRACT

An electrophotographic lithographic printing plate precursor is disclosed, comprising a conductive support having provided thereon at least one photoconductive layer containing photoconductive zinc oxide and a resin binder, wherein said resin binder comprises a resin containing at least one functional group capable of forming a carboxylic acid upon being decomposed. The printing plate precursor forms an image faithful to an original and causes no background stains because of improved oil-insensitivity of non-image areas, and a printing plate obtained therefrom exhibits high stain resistance and printing durability.

12 Claims, No Drawings

ELECTROPHOTOGRAPHIC ZINC OXIDE-RESIN BINDER LITHOGRAPHIC PRINTING PLATE PRECURSOR

FIELD OF THE INVENTION

This invention relates to an electrophotographic lithographic printing plate precursor, and, more particularly, to a novel resin binder forming a photoconductive layer of a lithographic printing plate precursor.

BACKGROUND OF THE INVENTION

A number of offset printing plate precursors for directly producing printing plates have hitherto been proposed, and some of them have already been put into practical use. Widely employed among them is a system in which a photoreceptor comprising a conductive support having provided thereon a photoconductive layer mainly comprising photoconductive particles, e.g., zinc oxide, and a resin binder is subjected to ordinary electrophotographic processing to form a highly lipophilic toner image thereon, and the surface of the photoreceptor is then treated with an oil-desensitizing solution, referred to as an etching solution, to selectively render non-image areas hydrophilic in order to obtain an offset printing plate.

Requirements of offset printing plate precursors for obtaining satisfactory prints are such that: an original should be reproduced faithfully on the photoreceptor; the surface of a photoreceptor has affinity with an oil-desensitizing solution so as to render non-image areas sufficiently hydrophilic, and, at the same time, has water resistance; and that a photoconductive layer having formed thereon an image is not released during printing and is well receptive to moistening water so that the non-image areas hold stains even on printing a large number of prints.

It is known that these performance properties of the printing plate precursors are influenced by the ratio of zinc oxide to resin binder in the photoconductive layer. For example, as the ratio of resin binder to zinc oxide particles becomes small, oil-insensitivity of the surface of the photoconductive layer is increased, to reduce background stains, but, in turn, the internal cohesion of the photoconductive layer per se is weakened, resulting in reduction of printing durability due to insufficient mechanical strength. On the other hand, as the proportion of the resin binder increases, printing durability is improved, while background staining becomes conspicuous. With respect to background staining, while it is a phenomenon associated with the degree of oil-desensitization achieved, it has been elucidated that the oil-insensitivity of the photoconductive layer surface depends not only on the size oxide/resin binder ratio in the photoconductive layer, but also depends greatly on the kind of resin binder used.

Resin binders which have been conventionally known include silicone resins (see Japanese Patent Publication No. 6670/59), styrene-butadiene resins (see Japanese Patent Publication No. 1960/60), alkyd resins, maleic acid resins, polyamides (see Japanese Patent Publication No. 11219/60), vinyl acetate resins (see Japanese Patent Publication No. 2425/66), vinyl acetate copolymer resins (see Japanese Patent Publication No. 2426/66), acrylic resins (see Japanese Patent Publication No. 11216/60), acrylic ester copolymer resins (see Japanese Patent Publication Nos. 11219/60, 8510/61, and 13946/66), etc. However, electrophotographic light-sensitive materials using these known resins suffer from any of disadvantages, such as low charging characteristics of the photoconductive layer; poor quality of a reproduced image, particularly dot reproducibility or resolving power; low sensitivity to exposure; insufficient oil-insensitivity attained by oil-desensitization for use as an offset master, which results in background stains on prints when used for offset printing; insufficient film strength of the light-sensitive layer, which causes release of the light-sensitive layer during offset printing, failing to obtain a large number of prints; and the like.

For particular use as an offset printing plate precursor, formation of background stains due to insufficient oil-insensitivity presents a serious problem. In order to solve this problem, various resins as binders for zinc oxide have been proposed, including a resin having a molecular weight of from 1.8 to $1.0\times10^4$ and a glass transition point of from 10° to 80° C. obtained by copolymerizing a (meth)acrylate monomer and a copolymerizable monomer in the presence of fumaric acid in combination with a copolymer of a (meth)acrylate monomer and a copolymerizable monomer other than fumaric acid as disclosed in Japanese Patent Publication No. 31011/75; a terpolymer containing a (meth)acrylic ester unit having a substituent having a carboxylic group at least 7 atoms distant from the ester linkage as disclosed in Japanese patent application (OPI) No. 54027/78 (the term "OPI" as used herein means "unexamined published patent applcation"); a tetramer or pentamer containing an acrylic acid unit and a hydroxyethyl (meth)acrylate unit as disclosed in Japanese patent application (OPI) Nos. 20735/79 and 202544/82; a terpolymer containing a (meth)acrylic ester unit having an alkyl group having from 6 to 12 carbon atoms as a substituent and a vinyl monomer containing a carboxylic acid group as disclosed in Japanese patent application (OPI) No. 68046/83; and the like.

Nevertheless, evaluations of these resins proposed for improving oil-insensitivity revealed that none of them was satisfactory in terms of stain resistance, printing durability, and the like.

SUMMARY OF THE INVENTION

One object of this invention is to provide a lithographic printing plate precursor which reproduces an image faithful to an original, forms neither background stains evenly over the entire surface nor dot-like stains, and exhibits excellent oil-insensitivity.

Another object of this invention is to provide a lithographic printing plate which maintains sufficient hydrophilic properties on its non-image areas so as to have stain resistance and high printing durability even when used for printing a large number of prints.

It has now been found that the above objects can be accomplished by an electrophotographic lithographic printing plate precursor obtained from an electrophotographic photoreceptor comprising a conductive support having provided thereon at least one photoconductive layer containing photoconductive zinc oxide and a resin binder, wherein said resin binder is a resin containing at least one of functional groups represented by formula $$-COO-L$$

wherein L represents

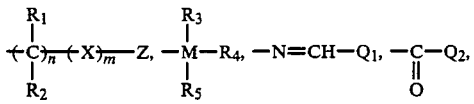

or —NH—OH, wherein $R_1$ and $R_2$ (which may be the same or different) each represents a hydrogen atom or an aliphatic group; X represents an aromatic group; Z represents a hydrogen atom, a halogen atom, a trihalomethyl group, an alkyl group, —CN, —$NO_2$, —$SO_2R_6$, wherein $R_6$ represents a hydrocarbon group, —$COOR_7$, wherein $R_7$ represents a hydrocarbon group, or —O—$R_8$, wherein $R_8$ represents a hydrocarbon group; n and m each represents 0, 1, or 2; $R_3$, $R_4$, and $R_5$ (which may be the same or different) each represents a hydrocarbon group or —O—$R_9$, wherein $R_9$ represents a hydrocarbon group; M represents Si, Sn, or Ti; and $Q_1$ and $Q_2$ each represents a hydrocarbon group.

DETAILED DESCRIPTION OF THE INVENTION

The functional groups of formula —COO—L is capable of forming a carboxyl group upon decomposition.

When L in formula —COO—L represents

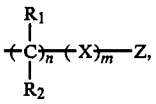

$R_1$ and $R_2$ each preferably represents a hydrocarbon group or a substituted or unsubstituted straight chain or branched chain alkyl group having from 1 to 12 carbon atoms (e.g., a methyl group, an ethyl group, a propyl group, a chloromethyl group, a dichloromethyl group, a trichloromethyl group, a trifluoromethyl group, a butyl group, a hexyl group, an octyl group, a decyl group, a hydroxyethyl group, a 3-chloropropyl group, etc.). X preferably represents a substituted or unsubstituted phenyl group or a naphthyl group (e.g., a phenyl group, a methylphenyl group, a chlorophenyl group, a dimethylphenyl group, a chloromethylphenyl group, a naphthyl group, etc.). Z preferably represents a hydrogen atom, a halogen atom (e.g., a chlorine atom, a fluorine atom, etc.), a trihalomethyl group (e.g., a trichloromethyl group, a trifluoromethyl group, etc.), a substituted or unsubstituted straight chain or branched chain alkyl group having from 1 to 12 carbon atoms (e.g., a methyl group, a chloromethyl group, a dichloromethyl group, an ethyl group, a propyl group, a butyl group, a hexyl group, a tetrafluoroethyl group, an octyl group, a cyanoethyl group, a chloroethyl group, etc.), —CN—, —$NO_2$, —$SO_2R_6$, wherein $R_6$ represents an aliphatic group (such as a substituted or unsubstituted alkyl group having from 1 to 12 carbon atoms, e.g., a methyl group, an ethyl group, a propyl group, a butyl group, a choroethyl group, a pentyl group, an octyl group, etc.; a substituted or unsubstituted aralkyl group having from 7 to 12 carbon atoms, e.g., a benzyl group, a phenethyl group, a chlorobenzyl group, a methoxybenzyl group, a chlorophenethyl group, a methylphenethyl group, etc.), or an aromatic group (such as a substituted or unsubstituted phenyl group and a naphthyl group, e.g., a phenyl group, a chlorophenyl group, a dichlorophenyl group, a methylphenyl group, a methoxyphenyl group, an acetylphenyl group, an acetamidophenyl group, a methoxycarbonylphenyl group, a naphthyl group, etc.), —$COOR_7$, wherein $R_7$ is the same as defined above, or —O—$R_8$, wherein $R_8$ has the same meaning as $R_6$; and n and m represents 0, 1, or 2.

Specific examples of the group represented by

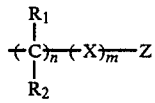

include a β,β,β-trichloroethyl group, a β,β,β-trifluoroethyl group, a hexafluoroisopropyl group, —$CH_2$—$(CF_2CF_2)_{n'}$H (wherein n' represents an integer of from 1 to 5), a 2-cyanoethyl group, a 2-nitroethyl group, a 2-methanesulfonylethyl group, a 2-ethanesulfonylethyl group, a 2-butanesulfonylethyl group, a benzenesulfonylethyl group, a 4-nitrobenzenesulfonylethyl group, a 4-cyanobenzenesulfonylethyl group, a 4-methylbenzenesulfonylethyl group, a substituted or unsubstituted benzyl group (e.g., a benzyl group, a methoxybenzyl group, a trimethylbenzyl group, a pentamethylbenzyl group, a nitrobenzyl group, etc.), a substituted or unsubstituted phenacyl group (e.g., a phenacyl group, a bromophenacyl group, etc.), a substituted or unsubstituted phenyl group (e.g., a phenyl group, a nitrophenyl group, a cyanophenyl group, a methanesulfonylphenyl group, a trifluoromethyl group, a dinitrophenyl group, etc.), and the like.

When L in formula —COO—L represents

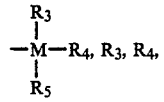

and $R_5$ each preferably represents a substituted or unsubstituted aliphatic group having from 1 to 18 carbon atoms (the aliphatic group includes an alkyl group, an alkenyl group, an aralkyl group, and an alicyclic group, and the substitutents include a halogen atom, —CN, —OH, —O—Q', etc., wherein Q' represents an alkyl group, an aralkyl group, an alicyclic group, or an aryl group), a substituted alicyclic group, or an aryl group), a substituted or unsubstituted aromatic group having from 6 to 18 carbon atoms (e.g., a phenyl group, a tolyl group, a chlorophenyl group, a methoxyphenyl group, an acetamidophenyl group, a naphthyl group, etc.), or —O—$R_9$ (wherein $R_9$ represents a substituted or unsubstituted alkyl group having from 1 to 12 carbon atoms, a substituted or unsubstituted alkenyl group having from 2 to 12 carbon atoms, a substituted or unsubstituted aralkyl group having from 7 to 12 carbon atoms, a substituted or unsubstituted alicyclic group having from 5 to 18 carbon atoms, or a substituted or unsubstituted aryl group having from 6 to 18 carbon atoms).

M represents a silicon atom, a titanium atom, or a tin atom, and preferably a silicon atom.

When L represents —N=CH—$Q_1$ or

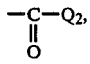

$Q_1$ and $Q_2$ each preferably represents a substituted or unsubstituted aliphatic group having from 1 to 18 carbon atoms (the aliphatic group includes an alkyl group, an alkenyl group, an aralkyl group, or an alicyclic group, and the substituents include a halogen atom, —CN, and alkoxy group, etc.) or a substituted or unsubstituted aryl group having from 6 to 18 carbon atoms (e.g., a phenyl group, a methoxyphenyl group, a tolyl group, a chlorophenyl group, a naphthyl group, etc.).

L in formula —COO—L preferably represents

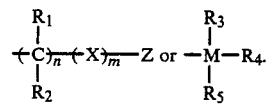

The resin containing at least one of the functional groups of formula —COO—L which can be used in the present invention can be obtained by a process which comprises converting a carboxyl group contained in a polymer into the functional group of formula —COO—L through a so-called high-molecular reaction, or a process which comprises polymerizing at least one monomer containing at least one of the functional groups of formula —COO—L or copolymerizing such a monomer with other copolymerizable monomer(s).

Examples of the monomers which can be copolymerized with the functional group-containing monomers include vinyl or allyl esters of aliphatic carboxylic acids, e.g., vinyl acetate, vinyl propionate, vinyl butyrate, allyl acetate, allyl propionate, etc.; esters or amides of unsaturated carboxylic acids, e.g., acrylic acid, methacrylic acid, crotonic acid, itaconic acid, maleic acid, fumaric acid, etc.; styrene derivatives, e.g., styrene, vinyltoluene, α-methylstyrene, etc.; α-olefins; acrylonitrile, methacrylonitrile; vinyl-substituted heterocyclic compounds, e.g., N-vinylpyrrolidone, etc.; and the like.

For details of the above-described processes, reference can be made, e.g., to Nihon Kagakukai (ed.), "Yuki Kagobutsu no Gosei to Han-no (V)", *Jikken Kagaku Koza,* Vol. 14, p. 2535, Maruzen K.K.; Y. Iwakura and K. Kurita, *Hannosei Kobunshi,* p. 170, Kodansha, etc.

Of the above-described processes, the latter is preferred to the former because this process can arbitrarily control the functional group —COO—L and allows no incorporation of impurities. In some detail, according to this process, a carboxyl group of a carboxylic acid containing a polymerizable double bond is coverted to any of the functional groups of formula —COO—L by the process described in the above-cited references, and the resulting functional group-containing compound is polymerized.

The resin according to the present invention has a molecular weight of from $10^3$ to $10^6$, and preferably from $5\times10^3$ to $10^5$.

The resin containing the functional group of formula —COO—L is a homo- or copolymer comprising from 0.5 to 100% by weight, of a monomer unit having the functional group —COO—L, and preferably a copolymer comprising from 1 to 99.9% by weight, of a monomer unit having the functional group —COO—L.

In the present invention, conventional known resins may also be used as a binder in combination with the above-described resins according to the present invention. Such resins include silicone resins, alkyd resins, vinyl acetate resins, polyester resins, styrene-butadiene resins, acrylic resins, and the like. Specific examples of these resins are described, e.g., in T. Kurita et al., *Kobunshi,* Vol. 17, p. 278 (1968), H. Miyamoto et al., *Imaging,* No. 8, p. 9 (1973), etc.

The resin according to the present invention and the known resins may be used over a wide range of mixing ratios, but, it is necessary that the resin of the invention, i.e., the resin containing the functional group of formula —COO—L be used in an amount of from 0.5 to 60% by weight, and more preferably from 1 to 30% by weight, based on the total resin. If the proportion of the resin of the invention is less than 0.5% by weight, the resulting lithographic printing plate precursor does not show sufficient oil-insensitivity when processed with an oil-desensitizing solution or moistening water, thus resulting in stain formation during printing. On the other hand, if it exceeds 60% by weight, the resulting printing plate precursor tends to have deteriorated image-forming performance, and also the photoconductive layer tends to have reduced film strength, leading to deteriorated mechanical durability on printing.

The resin according to the present invention which contains at least one of the functional groups of formula —COO—L is hydrolyzed or hydrogenolyzed upon contact with an oil-desensitizing solution or moistening water used on printing thereby to form a carboxyl group. Therefore, when the resin is used as a binder for a lithographic printing plate precursor, hydrophilic properties of non-image areas attained by processing with an oil-desensitizing solution can be enhanced by the thus formed carboxyl groups. As a result, a marked contrast can be afforded between lipophilic properties of image areas and hydrophilic properties of non-image areas to prevent adhesion of a printing ink onto the non-image areas during printing.

In the case where conventional resins containing carboxyl groups per se are employed in the production of lithographic printing plate precursors, a dispersion of zinc oxide in these resins has a viscosity that is too increased to be coated on a support. If it may be coated, the resulting photoconductive layer has seriously deteriorated smoothness, insufficient film strength, and unsatisfactory electrophotographic characteristics, and also easily forms stains during printing.

These unfavorable phenomena associated with the conventional lithographic printing plate precursors are presumably attributed to the strong interaction between carboxyl groups in the resin binder and surfaces of photoconductive zinc oxide particles, which increases resin absorption on the surfaces of zinc oxide particles. As a result, compatibility of the photoconductive layer with an oil-desensitizing solution or moistening water is impaired.

According to the present invention using the resin in which the carboxyl groups are protected to have the form of —COO—L, strong interaction with zinc oxide particles is suppressed, while hydrophilic carboxyl groups are formed upon processing with an oil-desensitizing solution, to thereby improve hydrophilic properties of non-image areas.

The photoconductive layer of the lithographic printing plate precursor according to the present invention usually comprises from 10 to 60 parts by weight, and preferably from 15 to 30 parts by weight, of the resin binder per 100 parts by weight of photoconductive zinc oxide. If desired, the photoconductive layer may further contain various additives known for electrophotographic light-sensitive layers, such as sensitizing dyes including xanthene dyes, cyanine dyes, etc. (e.g., Rose Bengal), chemical sensitizers, e.g., acid anhydrides, and the like. Specific examples of usable additives are described, e.g., in H. Miyamoto et al., *Imaging,* No. 8, p. 12 (1973). The total amount of these additives ranges from 0.0005 to 2.0 parts by weight per 100 parts by weight of a photoconductive substance.

The photoconductive layer according to the present invention can be provided on any known support. In general, a support for an electrophotographic light-sensitive layer is preferably electrically conductive. Any of conventionally employed conductive supports may be utilized in this invention. Examples of usable conductive supports include a base, e.g., a metal sheet, paper, a plastic sheet, etc., having been rendered electrically conductive by, for example, impregnating with a low resistant substance; a base with the back side thereof (opposite to the light-sensitive layer side) being rendered conductive and further coated thereon at least one layer for the purpose of preventing of curling, etc.; the aforesaid supports having provided thereon a water-resistant adhesive layer; the aforesaid supports having provided thereon at least one precoat layer; paper laminated with a plastic film on which aluminum, etc. is deposited; and the like.

Specific examples of conductive supports and materials for imparting conductivity which can be used in the present invention are described in S. Sakamoto, Denshishashin, Vol. 54, No. 1, pp. 2 to 11 (1975); H. Moriga, *Nyumon Tokushushi no Kagaku,* Kobunshi Kankokai (1975); M. F. Hoover, *J. Macromol. Sci. Chem.,* No. A-4(6), pp. 1327 to 1417 (1970); etc.

The present invention is now illustrates in greater detail by way of example, but it should be understood that the present invention is not limited thereto. In these examples, all the percents are by weight unless otherwise indicated.

EXAMPLE 1 AND COMPARATIVE EXAMPLES 1 to 3

A mixed solution consisting of 32 g of n-butyl methacrylate, 48 g of ethyl methacrylate, 20 g of 2,2,2-trifluoroethyl methacrylate, and 200 g of toluene was heated to 70° C. under a nitrogen stream, and 1.0 g of azobisisobutyronitrile (AIBN) was added thereto, followed by allowing to react for 8 hours. The resulting copolymer had a weight average molecular weight of 65,000.

A mixture of 40 g (solid base) of the resulting copolymer, 200 g of zinc oxide, 0.05 g of Rose Bengal, 0.01 g of phthalic anhydride, and 300 g of toluene was dispersed in a ball mill for 2 hours to prepare a light-sensitive coating composition. The composition was coated on paper having been rendered conductive to a dry coverage of 25 g/m$^2$ with a wire bar coater, followed by drying at 110° C. for 1 minute. The support having formed thereon a light-sensitive layer was then allowed to stand in a dark place at 20° C. and 65% RH for 24 hours to produce an electrophotographic lithographic printing plate precursor.

Comparative Samples A to C were produced in the same manner as described above, except for using copolymers shown below as a resin binder.

Sample A: A copolymer (weight average molecular weight: 68,000; solid content: 33.28%) prepared in the same manner as described above except for using a mixture consisting of 40 g of n-butyl methacrylate, 60 g of ethyl methacrylate, 0.2 g of acrylic acid, and 200 g of toluene.

Sample B: A copolymer (weight average molecular weight: 72,000; solid content: 33.3%) prepared in the same manner as described above except for using a mixture consisting of 38 g of n-butyl methacrylate, 57 g of ethyl methacrylate, 10 g of 2-hydroxyethyl methacrylate, 5.0 g of acrylic acid, and 200 g of toluene.

Sample C: A copolymer (weight average molecular weight: 67,000; solid content: 33.3%) prepared in the same manner as described above except for using a mixture consisting of 34 g of n-butyl methacrylate, 51 g of ethyl methacrylate, 15 g of acrylic acid, and 200 g of toluene.

Each of the resulting lithographic printing plate precursors was evaluated for film properties in terms of surface smoothness; electrostatic characteristics; oil-insensitivity of the photoconductive layer in terms of contact angle with water after oil-desensitization; reproduced image quality; and printing performances in terms of stain resistance in accordance with the following test methods.

(1) Smoothness of Photoconductive Layer:

The smoothness (sec/cc) was measured by means of a Beck's smoothness tester manufactured by Kumagaya Riko K.K. under an air volume condition of 1 cc.

(2) Electrostatic Characteristics:

The sample was negatively charged by corona discharge to a voltage of 6 kV for 20 seconds in a dark room at 20° C. and 65% RH using a paper analyzer ("Paper Analyzer SP-428" manufactured by Kawaguchi Denski K.K.). After the elapse of 10 seconds from the end of the corona discharge, the surface potential $V_0$ was measured. Then, the photoconductive layer was irradiated with visible light at an illumination of 2.0 lux, and the time required for dark decay of the surface potential $V_0$ to one-tenth was determined to obtain an exposure $E_{1/10}$ (lux.sec.).

(3) Contact Angle with Water:

The sample was passed once through an etching processor using an oil-desensitizing solution ("ELP-E" produced by Fuji Photo Film Co., Ltd.) to render the surface of the photoconductive layer oil-insensitive. On the thus oil-desensitized surface was placed a drop of 2 μl of distilled water, and the contact angle formed between the surface and water was measured by a goniometer.

(4) Stain Resistance:

The sample was processed with an automatic printing plate machine ("ELP 404V" manufactured by Fuji Photo Film Co., Ltd.) to form a toner image, and the surface of the photoconductive layer was subjected to oil-desensitization under the same conditions as in (3) above. The resulting printing plate (offset master) was mounted on a printer ("Hamada Star 800SX" manufactured by Hamada Star K.K.), and printing was carried out on fine paper in a conventional manner (Condition I, dampening water:water) to obtain 5000 prints. All the resulting prints were visually evaluated for background stains. The same evaluation was repeated except for printing under severe conditions, i.e., by using a 5-fold diluted oil-desensitizing solution and a 2-fold diluted dampening water for printing (Condition II).

(5) Printing Durability:

An offset master was produced from the sample, and printing was carried out in the same manner as in Condition I of (4) above except for using ELP-E2 diluted with 5-fold water, as a dampening water. The number of prints obtained which were satisfactory in freedom from background stains on the non-image areas and image quality was taken as an indication of printing durability. The greater the number of prints, the higher the printing durability.

The results of these evaluations are shown in Table 1 below.

TABLE 1

| | Sample of Example 1 | Sample A | Sample B | Sample C |
|---|---|---|---|---|
| Surface Smoothness (sec/cc) | 80 | 80 | 60 | 10 |
| Electrostatic Characteristics: | | | | |
| $V_0$ (V) | 550 | 550 | 560 | 600 |
| $E_{1/10}$ (lux sec) | 8.0 | 8.0 | 9.2 | 14.0 |
| Contact Angle with Water (°C.) | 3 | 20 | 17 | 25 |
| Quality of Reproduced Image | excellent | excellent | good | poor |
| Stain Resistance: | | | | |
| Condition I | excellent | excellent | poor | very poor |
| Condition II | excellent | poor | very poor | extremely poor |
| Printing Durability | more than 10,000 prints | 3000 prints | 100 prints | stains observed from the beginning |

As can be seen from Table 1, the images reproduced on the printing plate precursor of the invention and Samples A were clear, whereas those of Sample B and C were not clear due to high fog on the non-image areas. In addition, Sample C had seriously deteriorated surface smoothness.

In general, the smaller the contact angle with water, the higher the hydrophilic properties. Of the samples having been processed with an oil-desensitizing solution, the sample according to the invention has a small contact angle with water, while any of Samples A to C has a contact angle as large as 15° or more. When each of these samples was used as an offset master plate, only the plate of the invention was found produce satisfactory prints free from background stains on the non-image areas.

Further, more than 10,000 clear prints were obtained from the printing plate of the invention, whereas each of Samples A to C formed background stains. Formation of background stains was particularly conspicuous in the case of Samples B and C in which copolymers having a high carboxyl group content were used as a resin binder.

From all these considerations, it is apparent that the printing plate precursor according to the present invention provides an excellent master plate for offset printing which can produce a large number of prints free from background stains and having satisfactory electrophotographic characteristics.

EXAMPLE 2

A mixture consisting of 51 g of benzyl methacrylate, 34 g of butyl methacrylate, 15 g of hexafluoroisopropyl methacrylate, 0.3 g of methacrylic acid, and 200 g of toluene was heated to 75° C. under a nitrogen stream, and 1.0 g of AIBN was added thereto, followed by allowing to react for 8 hours. The resulting copolymer has a weight average molecular weight of 67,000.

A printing plate precursor was produced in the same manner as in Example 1 except for using the thus prepared copolymer as a resin binder. When the printing plate precursor was processed with ELP 404V in the same manner as in Example 1, the resulting master plate for offset printing had a clear reproduced image having a density of 1.0 or more. After etching processing, printing was carried out to obtain more than 10,000 clear prints free from fog in the non-image areas.

EXAMPLE 3

A mixture consisting of 20 g of styrene, 65 g of ethyl methacrylate, 15 g of 2-cyanoethyl methacrylate, and 200 g of toluene was heated to 80° C. under a nitrogen stream, and 1.5 g of AIBN was added thereto, followed by allowing the mixture to react for 8 hours. The resulting copolymer had a weight average molecular weight of 53,000.

A printing plate precursor was produced in the same manner as in Example 1 with 30 g (solid base) of the thus prepared copolymer and 10 g (solid base) of an ethyl methacrylate/acrylic acid (99/1 by weight). Processing with ELP 404V produced an offset master plate having a clear reproduced image having a density of 0.9 or more. After etching processing, printing was carried out to obtain more than 10,000 clear prints free from fog.

Further, when the same evaluations as above were repeated after the printing plate precursor was allowed to stand for 1 year, no change in performance properties was observed at all.

EXAMPLE 4

A mixture consisting of 30 g of butyl methacrylate, 45 g of ethyl methacrylate, 25 g of 4-(hexafluoroisopropylcarbonyloxy)styrene, 0.1 g of itaconic acid, and 200 g of toluene was heated to 75° C. under a nitrogen stream, and 1.0 g of AIBN was added thereto, followed by allowing the mixture to react for 8 hours. The resulting copolymer had a weight average molecular weight of 68,000.

A printing plate precursor was produced in the same manner as in Example 1 except for using the thus prepared copolymer, and the resulting plate precursor was processed with ELP 404V, subjected to etching processing, and then used for printing as an offset master plate. The master plate had a clear reproduced image having a density of 1.0 or more, and produced more than 10,000 clear prints free from background fog.

As described above, the lithographic printing plate precursors in accordance with the present invention reproduce an image faithful to an original and cause no background stains during printing due to the satisfactory hydrophilic properties of the surface smoothness, electrostatic characteristics, and printing durability.

While the invention has been described in detail and with reference to specific embodiments thereof, it will be apparent to one skilled in the art that various changes and modifications can be made therein without departing from the spirit and scope thereof.

What is claimed is:

1. An electrophotographic lithographic printing plate precursor obtained from an electrophotographic photoreceptor comprising a conductive support having provided thereon at least one photoconductive layer containing photoconductive zinc oxide and a resin binder, said printing plate precursor being capable of producing a lithographic printing plate by a process involving forming an electrophotographic image on said photoconductive layer followed by subjecting said photoconductive layer to an oil-desensitization treatment, wherein said resin binder comprises a resin containing at least one functional group represented by formula

—COO—L capable of forming a carboxyl group upon decomposition by an oil-desensitization treatment wherein L is selected from the group consisting of

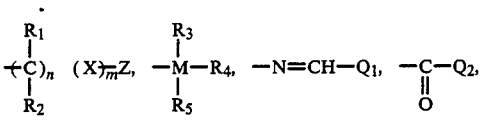

and —NH—OH, wherein $R_1$ and $R_2$ are each selected from the group consisting of a hydrogen atom or an aliphatic group; X represents an aromatic group; Z is selected from the group consisting of a hydrogen atom, a halogen atom, a trihalomethyl group, an alkyl group, —CN, $—NO_2$, $—SO_2R_6$, wherein $R_6$ represents a hydrocarbon group, $—COOR_7$, wherein $R_7$ represents a hydrocarbon group, and $—O—R_8$, wherein $R_8$ represents a hydrocarbon group; n and m are each 0, 1, or 2, provided that when both n and m represent 0, z is not hydrogen; $R_3$, $R_4$, and $R_5$ are each selected from the group consisting of a hydrocarbon group and $—O—R_9$, wherein $R_9$ represents a hydrocarbon group; M is Si,Sn, or Ti; and $Q_1$ and $Q_2$ each represent a hydrocarbon group.

2. An electrophotographic lithographic printing plate precursor as in claim 1, wherein L represents

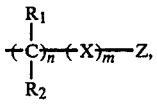

$R_1$ and $R_2$ each represents a hydrogen atom or a substituted or unsubstituted straight chain or branched chain alkyl group having from 1 to 12 carbon atoms; X represents a substituted or unsubstituted phenyl group; Z represents a halogen atom, a trihalomethyl group, a substituted or unsubstituted straight chain or branched chain alkyl group having from 1 to 12 carbon atoms, —CN, $—NO_2$, $—SO_2R_6$, wherein $R_6$ represents an aliphatic group or an aromatic group, $—COOR_7$, wherein $R_7$ represents a hydrocarbon group, or $—O—R_8$, wherein $R_8$ has the same meaning as $R_6$; and n and m represents 0, 1, or 2.

3. An electrophotographic lithographic printing plate precursor as in claim 1, wherein L represents

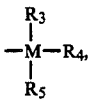

wherein $R_3$, $R_4$, and $R_5$ are each selected from the group consisting of a substituted or unsubstituted aliphatic group having from 1 to 18 carbon atoms, a substituted or unsubstituted aromatic group having from 6 to 18 carbon atoms, and $—O—R_9$, wherein $R_9$ is selected from the group consisting of a substituted or unsubstituted alkyl group having from 1 to 12 carbon atoms, a substituted or unsubstituted alkenyl group having from 2 to 12 carbon atoms, a substituted or unsubstituted aralkyl group having from 7 to 12 carbon atoms, a substituted or unsubstituted alicyclic group having from 5 to 18 carbon atoms, and a substituted or unsubstituted aryl group having from 6 to 18 carbon atoms; and M is a silicon atom.

4. An electrophotographic lithographic printing plate precursor as in claim 1, wherein L is selected from the group consisting of $—N{=}CH—Q_1$ and

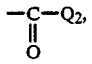

wherein $Q_1$ and $Q_2$ are each selected from the group consisting of a substituted or unsubstituted aliphatic group having from 1 to 18 carbon atoms and a substituted or unsubstituted aryl group having from 6 to 18 carbon atoms.

5. An electrophotographic lithographic printing plate precursor as in claim 1, wherein said resin has a molecular weight of from $10^3$ to $10^6$.

6. An electrophotographic lithographic printing plate precursor as in claim 5, wherein said resin has a molecular weight of from $5\times10^3$ to $10^5$.

7. An electrophotographic lithographic printing plate precursor as in claim 1, wherein said resin is a homopolymer or copolymer containing from 0.5 to 100% by weight of a repeating unit containing the functional group.

8. An electrophotographic lithographic printing plate precursor as in claim 7, wherein said resin is a copolymer containing from 1 to 99.9% by weight of a repeating unit containing the functional group.

9. An electrophotographic lithographic printing plate precursor as in claim 1, wherein said resin is present in an amount of from 0.5 to 60% by weight based on the total weight of the resin binder.

10. An electrophotographic lithographic printing plate precursor as in claim 9, wherein said resin is present in an amount of from 1 to 30% by weight based on the total weight of the resin binder.

11. An electrophotographic lithographic printing plate precursor as in claim 1, wherein said resin binder is present in an amount of from 10 to 60 parts by weight per 100 parts by weight of photoconductive zinc oxide.

12. An electrophotographic lithographic printing plate precursor as in claim 11, wherein said resin binder is present in an amount of from 15 to 30 parts by weight per 100 parts by weight of photoconductive zinc oxide.

* * * * *